United States Patent [19]

Tobler et al.

[11] 4,226,185

[45] Oct. 7, 1980

[54] PROJECTILE WITH A PAYLOAD

[75] Inventors: Bruno Tobler, Wallisellen; Hugo Sigrist, Hinwil, both of Switzerland

[73] Assignee: Werkzeugmaschinenfabrik Oerlikon-Bührle AG, Zurich, Switzerland

[21] Appl. No.: 935,701

[22] Filed: Aug. 21, 1978

[30] Foreign Application Priority Data

Sep. 2, 1978 [CH] Switzerland ..... 10720/78

[51] Int. Cl.[3] ..... F42B 13/40

[52] U.S. Cl. ..... 102/35.4; 102/35.6

[58] Field of Search ..... 102/35, 35.2, 35.4, 102/35.6, 34.1, 37.1, 37.6, 4

[56] References Cited

U.S. PATENT DOCUMENTS

| | | | |
|---|---|---|---|
| 3,038,407 | 6/1962 | Robertson et al. | 102/35.4 X |
| 3,055,300 | 9/1962 | Stoehi | 102/35.4 |
| 3,863,569 | 2/1975 | Simmons | 102/35.6 |
| 4,013,009 | 3/1977 | Claude et al. | 102/35.6 |

*Primary Examiner*—Harold J. Tudor

*Attorney, Agent, or Firm*—Werner W. Kleeman

[57] ABSTRACT

A projectile having a payload, a first brake system and a second brake system at one side of the payload. A first explosive charge and a second explosive charge, separated from one another by a drive disk, are arranged at the other side of the payload and surrounded by a hollow projectile jacket.

In order to render as simple as possible the construction of such projectile and in order to make available for the payload as large as possible part of the cross-section of the projectile, there is provided a latching or locking location at the projectile jacket for a container and the payload. The container and payload can remain in the projectile jacket as long as the initially effective brake system brakes the projectile. For slowly lowering the payload with the other brake system the payload leaves the latching location and thus the projectile jacket.

8 Claims, 4 Drawing Figures

PROJECTILE WITH A PAYLOAD

BACKGROUND OF THE INVENTION

The present invention relates to a new and improved construction of a projectile having a payload, first and second brake systems at one side of the payload, a first explosive charge and a second explosive charge separated from one another by a drive disk and arranged at the other side of the payload and surrounded by a projectile jacket or casing.

With prior art projectiles of this type there is carried as the payload a pyrotechnic or flare body and as the brake system there are employed parachutes. Such type projectile is disclosed for instance in U.S. Pat. No. 3,834,312. With this construction the flare body or assemblage is surrounded by a cylindrical container or casing which, viewed in the direction of motion, is open at the rear. At the front this container is closed and carries delay and explosive charges. At the flare body there merges towards the rear a lengthwise divided tubular section or piece which is detachably connected with the flare body and forms a container for the main parachute. The flare composition is surrounded at its periphery by a total of three jackets if there is also taken into account the projectile jacket. One of these jackets exclusively serves for interconnecting the lengthwise divided tubular section with the flare body.

It is a drawback to package the flare body in an unnecessarily large number of containers, since such can only be accomplished by reducing the diameter of the flare body inasmuch as the outer diameter of a projectile is fixed. Such small diameter changes lead, however, to proportionately large changes in the cross-sectional area, since such is proportional to the square of the diameter.

In order to obtain as good as possible illumination of a terrain, it is important that the cross-sectional area of the flare body is as large as possible since such only burns at its end surface.

SUMMARY OF THE INVENTION

Hence, it is a primary object of the present invention to provide a new and improved construction of a projectile which is not associated with the aforementioned drawbacks and limitations of the prior art proposals heretofore discussed.

Another and more specific object of the present invention aims at the provision of a projectile structured to reliably and suitably accommodate a payload and having a relatively simple construction while rendering possible an available cross-section for the payload which is as great as possible.

Yet a further significant object of the present invention is to provide a new and improved projectile having a payload, which projectile is relatively simple in construction and design, relatively economical to manufacture, extremely reliable in operation, and provides as large as possible cross-sectional area for the payload so as to enhance the effectiveness thereof.

Now in order to implement these and still further objects of the invention, which will become more readily apparent as the description proceeds, the invention contemplates providing a locking or latching location in the projectile jacket for the container of the second brake system and the payload after ignition of the first explosive charge.

The explosive charges are preferably separated from one another by means of a drive disk. Such can accommodate, apart from the delay composition or charge, also explosive charges.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
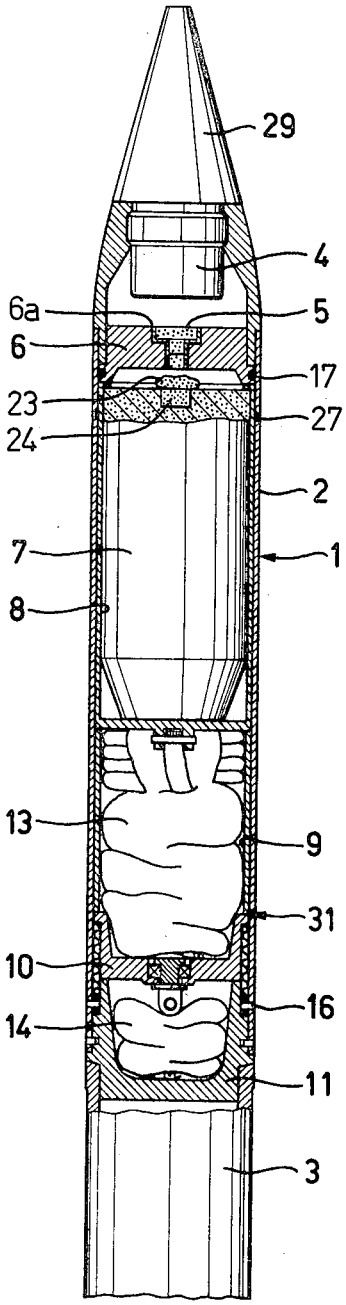
FIG. 1 is a longitudinal sectional view through a first exemplary embodiment of projectile having a payload and showing the same prior to ignition of the explosive charges.

Describing now the drawings, by referring to the projectile construction shown in FIG. 1 there will be recognized a projectile 1 composed of a substantially cylindrical, hollow projectile jacket or casing 2, which, viewed in the direction of firing of such projectile 1, is closed at its front end by a hood or cone 29 and at its rear end by a floor or base 11. By means of the floor or base 11 of the projectile 1 the latter is connected in any appropriate fashion to a rocket motor or engine housing 3. The projectile jacket 2 encloses a payload which is here in the form of a flare body or composition 7 surrounded by a sleeve 8, a parachute 13 fixed to the sleeve 8 and protected by a container 31 and a brake parachute 14 which is attached to the container 31. This container 31 is composed of the two half shells 9 and the intermediate floor 10.

A drive or propelling disk 6 is arranged between the flare body 7 and the hood 29. This drive disk 6 is configured such that towards the rear there is available space for an explosive charge 23. This explosive charge 23 is in contact with a star booster charge 24. With the embodiment shown in FIGS. 1 and 2 a bore 25 is provided at the center of the drive disk 6 and in which there is arranged a delay charge 22. An explosive charge 5 is inserted into a recess *6a* at the upper side or face of the drive disk 6.

Figure 3:
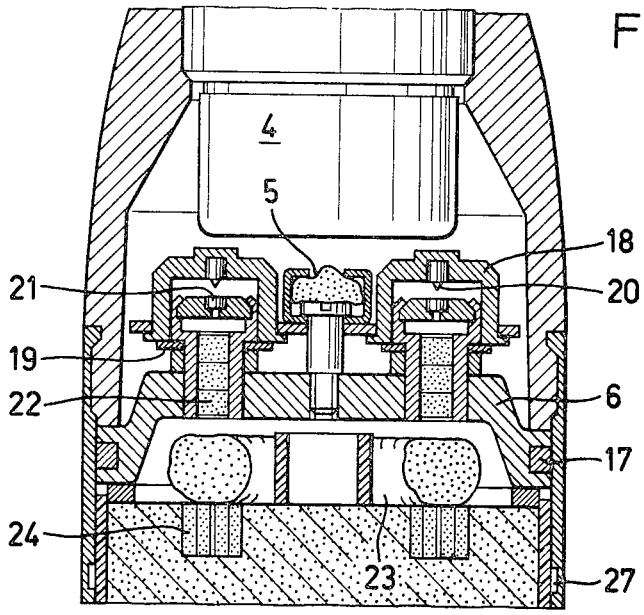
FIG. 3 is an enlarged longitudinal sectional view through the front portion of a second exemplary embodiment constructed according to the teachings of the present invention.

Continuing, with the exemplary embodiment of FIG. 3 there are mounted detonator caps 21 for the ignition of the delay charges 22 arranged externally of the central region of the projectile 1. The detonator caps 21 are triggered by the firing pins 20 which are arranged upon firing pin supports 18. These firing pin supports 18 are displaceable along their axes, but however are retained in their forwardmost position by the rings or ring members 19. The explosive charge 5 is arranged at the center and so as to protrude somewhat from the drive disk 6. In both exemplary embodiments the drive disk 6 carries at its periphery a resilient or spring ring 17 serving as anchoring means. When the drive disk 6 assumes a latching or locking position the resilient ring or ring member 17 jumps into a groove or recess 27 or equivalent structure provided at the projectile jacket 2. At the forwardmost location of the projectile 1, within the hood or cone 29, there is space for a fuze 4. There is preferably used a time fuze or delayed action fuze.

Figure 4:
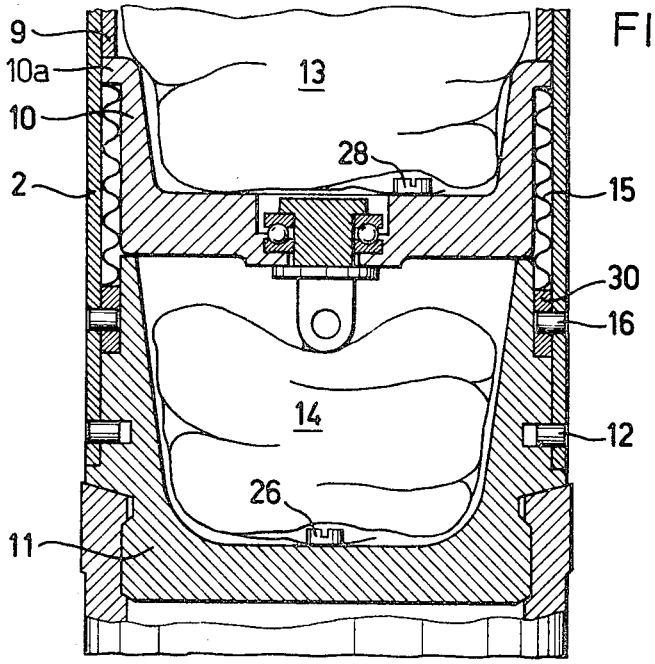
FIG. 4 is an enlarged sectional view through the rear portion or tail end of both exemplary embodiments of FIGS. 1 and 3, prior to ignition of the explosive charges.

Now by referring to FIG. 4 there will be recognized that the intermediate floor or bottom 10 is constructed so as to have an essentially container-like shape and is surrounded at its periphery by a metallic bellows or diaphragm 15 serving as damping means. This metallic bellows or diaphragm 15 or equivalent structure bears towards the rear, by means of a ring 30, at a releasable stop or impact member 16 constructed as a shearing bolt. Towards the front the metallic bellows 15 constituting the damping means bears against the outwardly directed flange edge 10a of the intermediate floor or bottom 10. The floor or base 11 of the projectile 1 is connected with the projectile jacket 2 by means of predetermined or reference breaking or fracture locations 12, here shown for instance in the form of shearing bolts. The screw 26 or equivalent structure serves for the additional attachment of the brake parachute 14 at the floor or base 11, whereas the screw 28 connects the parachute 13 with the intermediate floor 10.

Having now had the benefit of the foregoing discussion of the exemplary embodiments of projectiles having a payload and constructed according to the teachings of the invention, the mode of operation of such projectiles will now be considered and is as follows:

After expiration of the time which has been set at the fuze 4 the explosive charge 5 is ignited. By virtue of the gases which are produced by the explosive charge 5 there is exerted a rearwardly directed pressure or compressive force against the drive disk 6. This force is transmitted to the projectile floor 11 by means of the sleeve 8 surrounding the flare body 7, the half shells or bowls 9 and by means of the intermediate floor 10. Consequently, there are sheared the reference breakage or fracture locations 12 which have been designed in the form of shearing bolts. The drive disk 6, the flare body 7 with the parachute 13, the half shells 9, the intermediate floor 10 and the projectile floor 11 are moved towards the rear, so that the rocket motor or engine housing 3 separates from the projectile jacket 2 and draws the brake parachute 14 out of the rear part of the projectile 1, as best seen by referring to FIG. 2. The brake parachute 14 which is connected by means of the screw 26 or other equivalent fastening expedients with the floor 11 unfolds and there is torn its connection with the floor 11. The projectile 1 is braked. The movement of the drive disk 6, the flare body 7, the half shells 9 and the intermediate floor 10, after shearing through of the reference fracture locations 12, is reduced owing to the thus occurring deformation of the damping means 15 to such an extent that detachable stops 16 do not shear off upon impact thereagainst of the intermediate floor 0. Now when the drive disk has reached its rear end position the spring or resilient ring 17 snaps into the groove 27. This securing action prevents that drive disk 6, upon sudden braking of the projectile 1 by the brake parachute 14, will be moved together with the flare body 7 again towards the front. The payload in the form of the flare body 7, the second brake system 13 with its container 31 and the drive disk 6 thus have assumed there latching or locking position.

Now in the exemplary embodiment of FIG. 3, following the ignition of the explosive charge 5 the firing pin supports 18 are loaded by the pressure prevailing in front of the drive disk 6 and shear off the rings 19. The rearwardly moved firing pins 20 puncture the detonator caps 21, thereby igniting the delay charges 22. After expiration of about 2 to 3 seconds, and triggered by the delay charges 22, there is accomplished the ignition of the explosive charge 23. The pressure force exerted by the gases of the explosive charge 23 and formed between the drive disk 6 and the end surface or face of the flare body 7 is transmitted by means of the flare body 7, the half shells 9 and the intermediate floor 10 to the releasable stops 16 which are thus sheared. By virtue of the gases there is simultaneously ignited the star booster charge 24 and by means of such the flare body or composition 7, and the flare body 7 connected with the parachute 13, the half shells 9 and the intermediate floor 10 connected with the brake parachute 14 are ejected rearwardly out of the projectile jacket 2. Externally of the projectile jacket 2 both of the half shells 9 and the intermediate floor 10 with the brake parachute 14 separate from the flare body 7 having the parachute 13, so that such now can open. While the flare body 7 is thus further braked by the parachute 13, the hood 29 together with the projectile jacket 2, the half shells 9 and the intermediate floor 10 connected with the brake parachute 14 drop to the ground.

Figure 2:
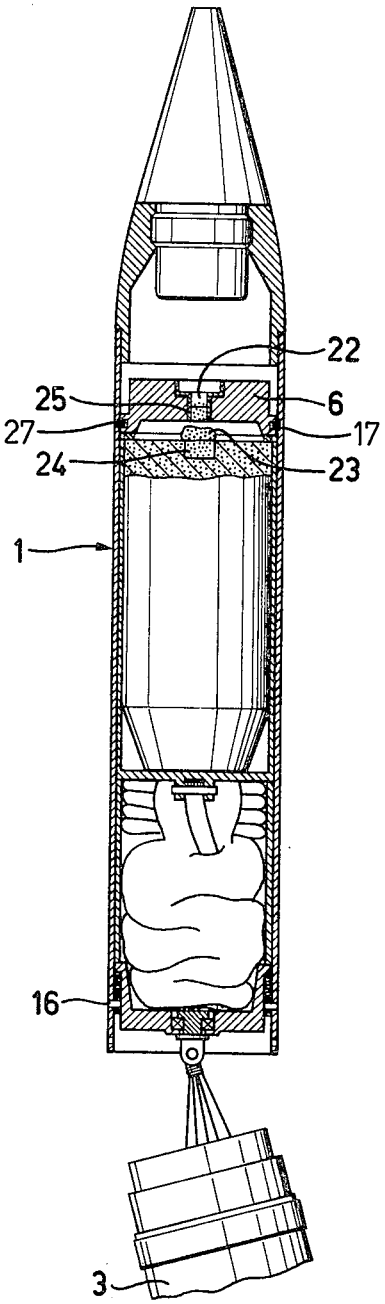
FIG. 2 is a longitudinal sectional view through the same embodiment as shown in FIG. 2, but here following the ignition of a first explosive charge.

In the embodiment shown in FIGS. 1 and 2 the delay charge 22 is directly ignited by the explosive charge 5. The explosive charge 23 arranged between the drive disk 6 and the flare body 7 then ignites the star booster charge 24 and such in turn ignites the flare body or composition 7.

One of the dominant advantages of this solution resides in the fact that the projectile jacket 2 connects the flare body 7 with the container or other receptacle 31 which contains the second brake system. Hence, there remains free for the payload a considerably large part of the cross-section of the projectile 1. Additionally, the projectile, upon ejection of the flare body, disintegrates into a few parts, which reduces the probability of unintentionally endangering ones own troops or installations.

Of course payloads different than flare compositions can be used, for instance radiation bodies or also measuring instruments which should be transported in a projectile of this type. Equally, the projectile can be placed into its trajectory in a number of different ways, for instance by firing it from a cannon or a rocket.

Also parachutes do not constitute the only possible braking systems which can be used to advantage for practicing the teachings of the invention. For instance, a balloon could directly assume this role. It is also conceivable to incorporate into a projectile two different types of brake or braking systems.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A projectile for a payload, comprising:

a hollow projectile jacket;

a payload arranged within said projectile jacket;

said payload having opposite ends;

a first brake system and a second brake system arranged to one side of one end of said payload;

a container within which there is arranged said second brake system;

means for connecting said second brake system with said payload;

said first brake system being arranged externally of said container containing said second brake system;

means for connecting said first brake system with said container;

a first explosive charge and a second explosive charge arranged towards the other side of the other end of said payload;

a drive disk arranged at said other side of said payload;

said drive disk separating said first explosive charge and said second explosive charge from one another;

said first explosive charge serving for releasing said first brake system;

said second explosive charge serving for releasing said second brake system;

said drive disk, said payload, and said container with said second brake system being arranged within said projectile jacket to assume a first position lengthwise of said projectile jacket prior to ignition of said first explosive charge; and means provided for said projectile jacket for defining a latching location within the projectile jacket for retaining the drive disk, the payload and the container in a second position within the projectile jacket which is spaced axially of said first position lengthwise of said projectile jacket after igniting the first explosive charge.

2. The projectile as defined in claim 1, wherein:

said means defining said latching location is provided with releasable stop means for releasing the container of the second brake system and the payload after ignition of the second explosive charge.

3. The projectile as defined in claim 2, wherein:

said releasable stop means comprise shearing bolt means distributed over the entire periphery of the cross-sectional area of the projectile jacket and a ring member.

4. The projectile as defined in claim 1, wherein:

said means defining said latching location is structured for the reception of anchoring means arranged at the drive disk.

5. The projectile as defined in claim 4, wherein:

said anchoring means arranged at said drive disk comprises a resilient ring;

said means defining said latching location further including groove means provided at the projectile jacket.

6. The projectile as defined in claim 2, further including:

damping means for damping the movement of the container and the payload after ignition of the first explosive charge prior to reaching the latching location.

7. The projectile as defined in claim 6, wherein:

said damping means is arranged between said releasable stop means and said container.

8. The projectile as defined in claim 7, wherein:

said damping means comprises a metallic bellows.

* * * * *